US008237006B2

(12) United States Patent
Stone et al.

(10) Patent No.: US 8,237,006 B2
(45) Date of Patent: Aug. 7, 2012

(54) THERMAL OXIDIZER WITH GASIFIER

(75) Inventors: James Stone, St. Charles, IL (US); Steven William Blocki, White Lake, MI (US)

(73) Assignee: Durr Systems, Inc., Plymouth, MI (US)

( * ) Notice: Subject to any disclaimer, the term of this patent is extended or adjusted under 35 U.S.C. 154(b) by 665 days.

(21) Appl. No.: 12/394,559

(22) Filed: Feb. 27, 2009

(65) Prior Publication Data

US 2009/0221866 A1 Sep. 3, 2009

Related U.S. Application Data

(60) Provisional application No. 61/032,765, filed on Feb. 29, 2008.

(51) Int. Cl.
*A62D 3/40* (2007.01)

(52) U.S. Cl. ..... 588/321; 588/400; 588/405; 588/406

(58) Field of Classification Search ..... 588/312–321, 588/400, 405, 406
See application file for complete search history.

(56) References Cited

U.S. PATENT DOCUMENTS 3,892,190 A * 7/1975 Sharpe ..... 588/320
4,552,082 A * 11/1985 Grey ..... 588/321
4,779,548 A 10/1988 Mueller et al.
5,531,593 A 7/1996 Klobucar
5,602,297 A * 2/1997 Wang ..... 588/321
5,730,945 A 3/1998 Klobucar
5,900,224 A * 5/1999 Fujimura et al. ..... 423/359
5,980,858 A * 11/1999 Fujimura et al. ..... 423/655
6,051,199 A 4/2000 Teller
6,126,913 A * 10/2000 Martin et al. ..... 423/245.3
6,143,553 A 11/2000 Teller
6,204,427 B1 * 3/2001 Eddy ..... 252/372
6,228,329 B1 5/2001 Garvey
7,018,447 B2 3/2006 McAnespie
7,534,926 B2 * 5/2009 Stegemeier et al. ..... 588/321
2004/0024279 A1 * 2/2004 Mason ..... 588/226
2004/0143149 A1 * 7/2004 DeCourcy et al. ..... 588/213
2007/0060659 A1 * 3/2007 Kindig et al. ..... 518/703
2008/0039674 A1 * 2/2008 Mason ..... 588/321
2010/0044643 A1 * 2/2010 Wallace ..... 252/373
2010/0312037 A1 * 12/2010 Jackson ..... 588/313

* cited by examiner

*Primary Examiner* — Wayne Langel
(74) *Attorney, Agent, or Firm* — Howard & Howard Attorneys PLLC

(57) ABSTRACT

A manufacturing apparatus for producing products results in solid waste and organic waste disposed in an air stream. The organic waste is subject to oxidation by a thermal oxidizer receiving the air stream from the manufacturing apparatus for oxidizing the organic waste. The thermal oxidizer includes a clean air outlet for venting the oxidized air stream to the atmosphere. A gasifier receives solid waste from the manufacturing apparatus for gasifying the solid waste and producing synthetic gas. The synthetic gas is introduced to the thermal oxidizer for providing additional thermal energy to the thermal oxidizer reducing the amount of fossil fuel required to provide thermal energy to the thermal oxidizer that is necessary for oxidizing the organic waste disposed in said air stream.

7 Claims, 6 Drawing Sheets

THERMAL OXIDIZER WITH GASIFIER

RELATED APPLICATIONS

This is a non-provisional application that claims priority to a provisional application Ser. No. 61/032,765 filed on Feb. 29, 2008 and incorporated herewith by reference in its entirety.

FIELD OF THE INVENTION

The present invention is directed generally to a manufacturing apparatus having a regenerative thermal oxidizer making use of a combined gasifier. More particularly, the present invention is related to a method of reducing the amount of fossil fuel generated carbon dioxide vented to the atmosphere by operating a regenerative thermal oxidizer by reducing the amount of fossil fuel required to operate the regenerative thermal oxidizer through the addition of carbon neutral synthetic gas generated by an integrated gasifier.

BACKGROUND OF THE INVENTION

It is well known that manufacturing processes produce waste byproducts harmful to the environment. These waste byproducts come in various forms, including aerosol, particulate, gaseous and solids. For example, volatile organic compounds are known to be vented from various manufacturing processes, including paint application processes, wood manufacturing processes, and other processes known to require heating or drying liquid chemical compounds.

To comply with environmental protection regulations, many of these manufacturing apparatus are fitted with thermal oxidizers to destroy harmful gaseous pollutants resulting from the industrial process gaseous waste byproduct. Thermal oxidizers heat the waste gases to temperatures that cause pollutants to spontaneously react with available oxygen inside the thermal oxidizer. The resultant oxidation reaction inside the thermal oxidizer converts oxide compounds to primarily, carbon dioxide and water that can be legally vented to the atmosphere.

To generate the necessary heat that causes pollutants to spontaneously react with available oxygen, thermal oxidizers are fitted with burners that generate heat by way of fossil fuels, namely natural gas or oil. Previously, attempts have been made to reduce the amount of fossil fuel required to generate enough British Thermal Units (BTUs) of energy to convert the pollutants to oxide compounds. For example, a common type of thermal oxidizer is known as a regenerative thermal oxidizer or RTO. The RTO includes a regenerative heat exchanger formed from adsorbent material to recover heat from the oxidizer exhaust and use that heat to preheat the incoming process exhaust stream. Preheating the incoming exhaust stream has proven to significantly reduce the fuel consumption of the burner. Not only does this reduce the costs associated with operating the RTO it also reduces the amount of $CO_2$ vented to the atmosphere as a result of burning fossil fuels reducing the carbon footprint required to operate the manufacturing apparatus. However, even the RTO requires mass consumption of fossil fuel to generate the necessary BTUs to oxidize the pollutants produced by the industrial process. For example, a typical RTO processing 100,000 $ft^3$ of polluted exhaust air per minute will consume 11,000,000 BTUs per hour of fossil fuel.

Given the high cost of fossil fuel, and even more particularly, the desire to reduce the amount of fossil fuel generated $CO_2$ vented to the atmosphere, it is desirable to find even further ways to reduce the amount of fossil fuel necessary to operate an RTO.

SUMMARY OF THE INVENTION

Continuous efforts have been undertaken by the Applicant to improve the efficiency of pollution abatement equipment to reduce the amount of $CO_2$ vented to the atmosphere from adding fossil fuels to the abatement equipment, such as, the regenerative thermal oxidizer (RTO) explained above.

A manufacturing apparatus that produces products resulting in both solid waste and organic waste exposed in air stream includes a thermal oxidizer that receives the air stream from the manufacturing apparatus for oxidizing the organic waste disposed in the air stream. The thermal oxidizer includes a clean-air outlet for venting the oxidized air stream to the atmosphere. A gasifier receives solid wastes from the manufacturing apparatus, or other unrelated apparatus, and gasifies the solid waste producing a synthetic gas. The synthetic gas is introduced to the thermal oxidizer for providing additional thermal energy to the thermal oxidizer to reduce the amount of fossil fuel required to provide thermal energy to the thermal oxidizer. Therefore, heat generated from the synthetic gas derived from the solid waste is used to provide energy to the thermal oxidizer to reduce the organic waste to carbon dioxide and water.

The combination of the gasifier to convert the solid waste byproduct to a fuel source and the RTO used to convert the energy source to carbon dioxide and water during pollution abatement provides the benefit of both cost efficiency and the replacement of fossil fuel generated $CO_2$ vented to the environment, believed to contribute to global warming, with carbon neutral $CO_2$ from gasified biomass. It is anticipated that a balanced manufacturing operation will significantly reduce or eliminate the necessity of fossil fuel required to operate an RTO. More than just a cost reduction, the benefit is that unnecessary $CO_2$ from burning the fossil fuel will not be vented to the atmosphere. Should carbon offsets become necessary in the future, the inventive process set forth above will enable the manufacturing operator to pay only offset taxes resultant from the manufacturing process and not those associated with burning fossil fuels.

DETAILED DESCRIPTION OF THE PREFERRED EMBODIMENT

Figure 1:
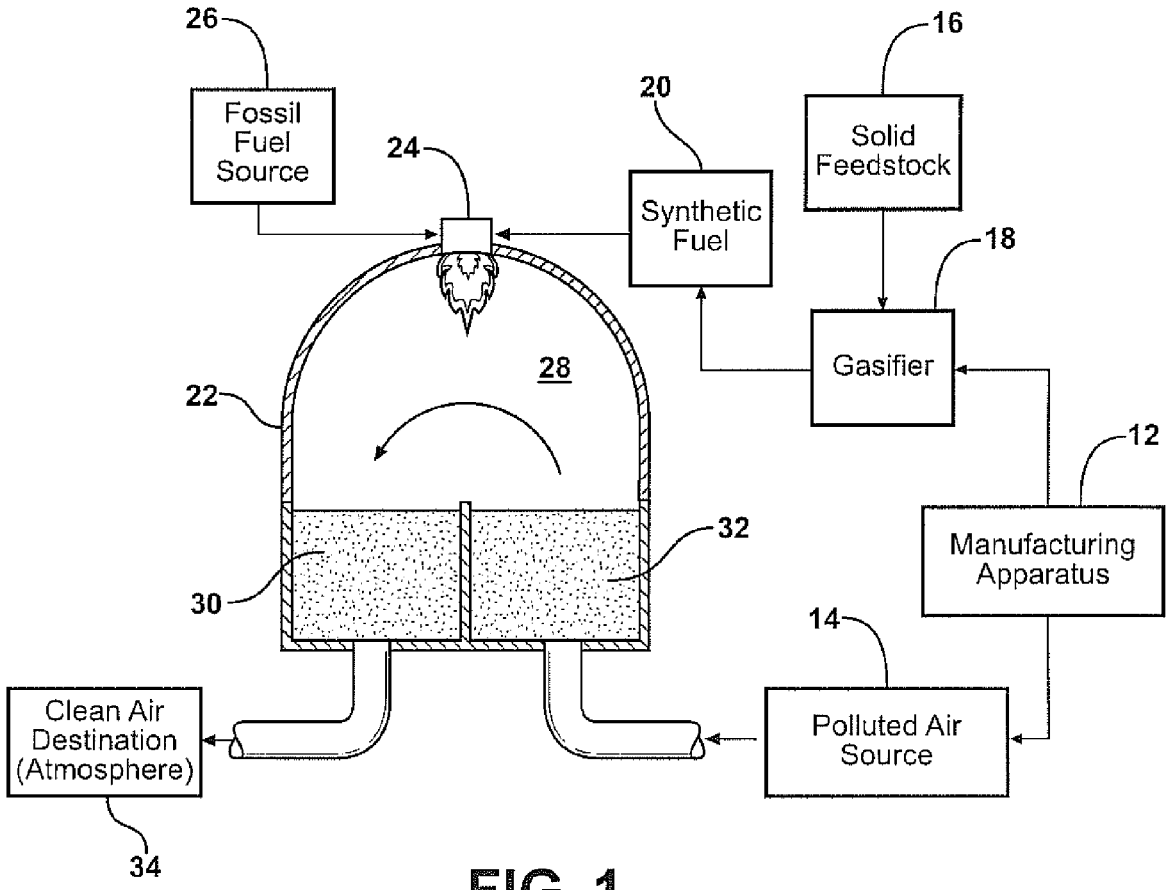
FIG. 1 shows a block diagram with manufacturing apparatus having a regenerative thermal oxidizer (RTO) with a gasifier showing a multi-fuel burner.

A manufacturing facility is generally shown in FIG. 1 at 10. The facility includes a manufacturing apparatus 12 that produces as a manufacturing byproduct, a polluted air source having, for example, volatile organic compound or other organic particulate matter disposed in a polluted air stream 14. One such example of the manufacturing apparatus 12 associated with the present invention is a paint application booth used for applying large volumes of industrial paint. It should be understand that the manufacturing facility 10 of the present invention could include any manufacturing process resulting in both aerosol and solid waste byproduct. For clarity, the inventive process and apparatus will be explained for use in a paint application facility throughout the specification. However, it should be understood that the solid waste byproduct used to generate synthetic gas may come from an industrial process not related to the industrial process producing polluted air stream requiring treatment.

An industrial manufacturing apparatus 12 used to apply paint to products, requires a paint booth (not shown) that vents organic solvents into the polluted air stream (14). Organic solvents are generally used to adjust the viscosity of the paint being applied to the products passing through the paint booth for enhanced paint quality. Although significant improvements have been made to the transfer efficiency from a paint applicator onto the product passing through a paint booth, significant volumes of paint, known as overspray, does not adhere to the product and is captured in a water stream passing alongside or below the product being painted. The paint overspray is filtered from the water stream resulting in a stream of solid waste feed stream stock (16) that heretofore has been sent to landfield. Attempts have also been made to recycle the paint overspray for use in various other products, but the cost associated with recycling the paint overspray has been prohibitive. The inventive manufacturing facility transfers the solid waste feed to the solid feed stock stream (16) and into a gasifier (18). The type of gasifier selected for the vented manufacturing apparatus 12 is dependent upon the type of solid waste product. However, the various types of gasifiers contemplated by the inventors includes, a countercurrent fixed head or updraft gasifier, a co-current fixed head or downdraft gasifier, a fluidized bed reactor gasifier, and an entrained flow gasifier. It should be understood by those skilled in the art that the gasifier 18 converts the solid waste product received through the solid feed stock line 16 is into hydrogen, carbon monoxide, and methane, dependent upon the chemical make-up of the solid waste product constituting a synthetic gas.

By way of further example, an RTO 22 is used in manufacturing facilities 10 that produce plywood, strand dashboard or particle board. These plants use RTOs 22 to control air pollutant emissions during the process of drying and forming wood products that make use of glues or urethane binders. This drying process vents volatile organic compounds that are abated in the RTO 22. The manufacturing apparatus 12 that produces these types of wood products also results in significant amounts of waste wood, including bark and other unusable portions of trees as well as sawdust from cutting and finishing operations. In this example, the solid wood byproduct constitutes a solid feed stock 16 for use in a gasifier 18 and a volatile organic component constitutes the polluted air stream 14 that is introduced into the RTO 22.

The synthetic gas is transferred through a synthetic gas line 20 to a thermal oxidizer 22. The thermal oxidizer is contemplated by the inventors to be an energy efficient regenerative thermal oxidizer. However, it should be understood by those skilled in the art that the thermal oxidizer can take different forms as required to efficiently oxidize pollutants received from the manufacturing apparatus 12. In this exemplary embodiment, the synthetic gas line 20 feeds synthetic gas received from the gasifier 18 to a burner 24 of the RTO 22. The burner 24 also receives fossil fuel from a fossil fuel source line 26 in a known manner. The balance between fossil fuel and synthetic gas delivered to the burner 24 will be explained further below. The burner 24 provides a combustive flame to a combustion chamber 28 of the RTO 22. The RTO 22 includes first adsorptive media 30 and second adsorptive media 32. The use of "adsorptive" should be understood to include adsorption of heat energy in addition to alternative oxidizers that may adsorb chemical particulate matter. The adsorptive media 30, 32 functions in a known manner by heating the polluted air received from the polluted air source 14 prior to entering the combustion chamber 28 and adsorbing particulate matter received from the combustion chamber 28 prior to transferring that air to a clean air conduit 34. The clean air conduit 34 vents the clean air, generally including $CO_2$ and water to the atmosphere.

The burner 24 is adapted to operate with both the fossil fuel received from the fossil fuel source 26 and synthetic gas received from the gasifier 18. The installation of the burner 24 onto the RTO 22 is conventional. However, the burner 24 runs on fossil fuel, namely either natural gas or oil, during times that gasifier fuel received from the gasifier 18 is unavailable. The burner 24 is also adapted to burn the gasifier fuel, having hydrogen, methane, or other combustible gases produced in the gasifier 18 from the solid waste feed stock. In the most desirable balance, very little or no natural gas or oil is required in the burner 24 as fuel, only by the synthetic gas received from the gasifier 18. It is believed that the gasifier fuel received from the gasifier 18 will have lower volumetric energy content than natural gas or oil. Therefore, the stoichiometric balance may require the natural gas or oil be mixed with air to reduce its volumetric energy content. In this instance, if the volumetric energy content is matched between the two fuels, either fuel can be fired into the burner through a single set of fuel nozzles. Of course, when the burner 24 is fueled only by gasifier fuel, the RTO 22 is not introducing any further fossil fuel generated $CO_2$ to the atmosphere, but only carbon neutral $CO_2$ to the environment through the clean air destination conduit 34. Not only does this reduce the cost associated with the acquisition of fossil fuel, by not introducing fossil fuels into the RTO, fossil fuel generated $CO_2$ vented to the atmosphere from the RTO is reduced. Therefore, reducing any necessary carbon offset than what is required from burning fossil fuel to provide energy to the RTO 22.

Figure 2:
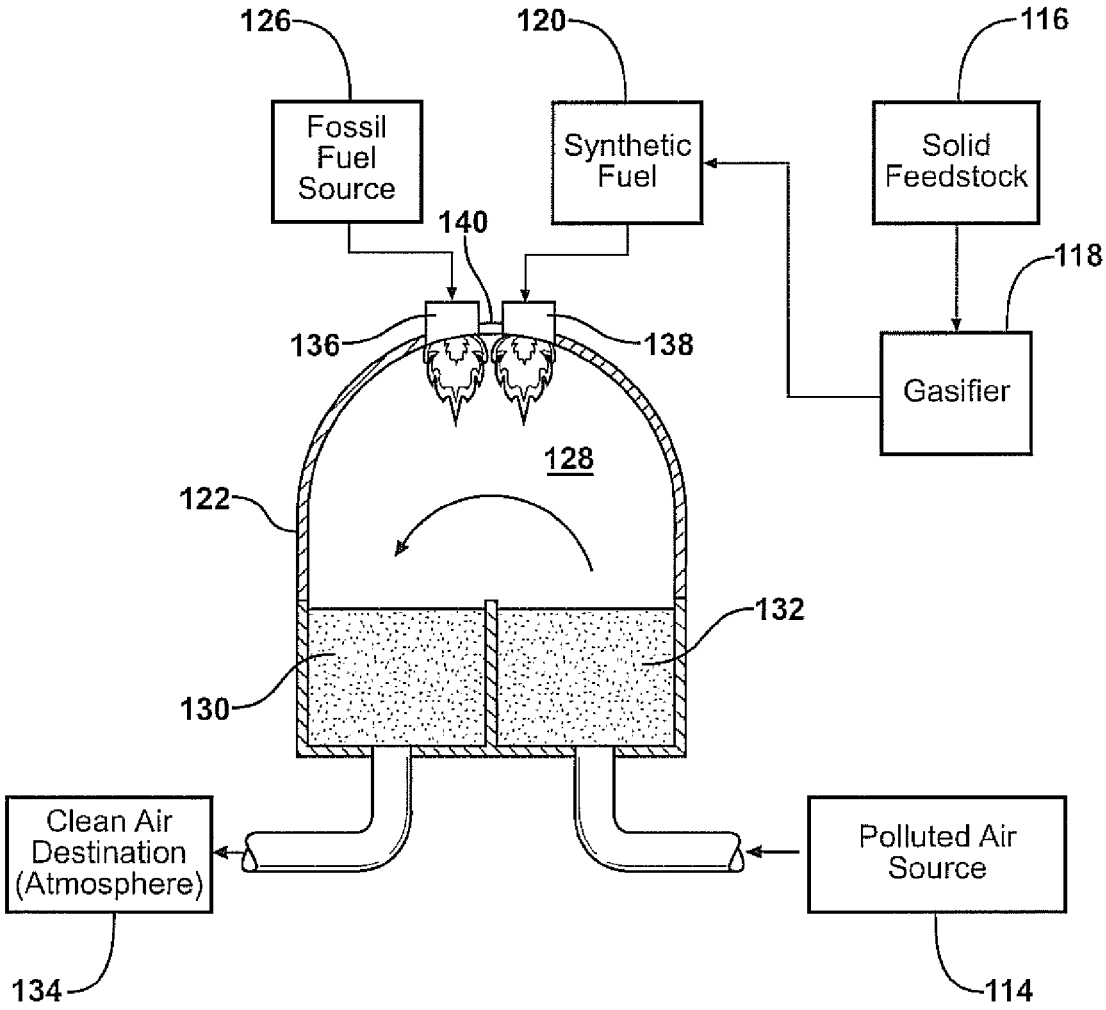
FIG. 2 shows a block diagram of an RTO with a gasifier having separate burners.

FIG. 2 represents an alternative embodiment of the RTO shown at 122 where common elements to the embodiment represented in FIG. 1 are numbered in the 100 series for simplicity. In this embodiment, a first burner 136 is charged by a fossil fuel from a fossil fuel source 126. The first burner 136 is designated solely for use with a fossil fuel received from the fossil fuel source 126. Therefore, the burner 136 is conventional in nature and does require modification to receive synthetic gas. Therefore, a second burner 138 receives synthetic gas from the gasifier 118 and is adapted for sole use with a synthetic gas. If enough synthetic gas is delivered by the gasifier to the second burner 138 providing enough British thermal units (BTUs) of energy to charge the combustion chamber 128 the first burner 136 is merely not operated. Alternatively, if no synthetic gas is available to charge the second burner 138, the second burner 138 is discharged and the first burner 136 provides all of the BTUs of energy to the combustion chamber 128. It should be understood that the first burner 136 and the second burner 138 can operate simultaneously to provide the appropriate amount of BTUs of energy to the combustion chamber 128 in order to efficiently operate the RTO 122. To operate the first burner 136 and the second burner 138 simultaneously, the volumetric flow meter 140 is desirable to monitor the gas flow from the fossil fuel source 126 and the gasifier 118.

Figure 3:
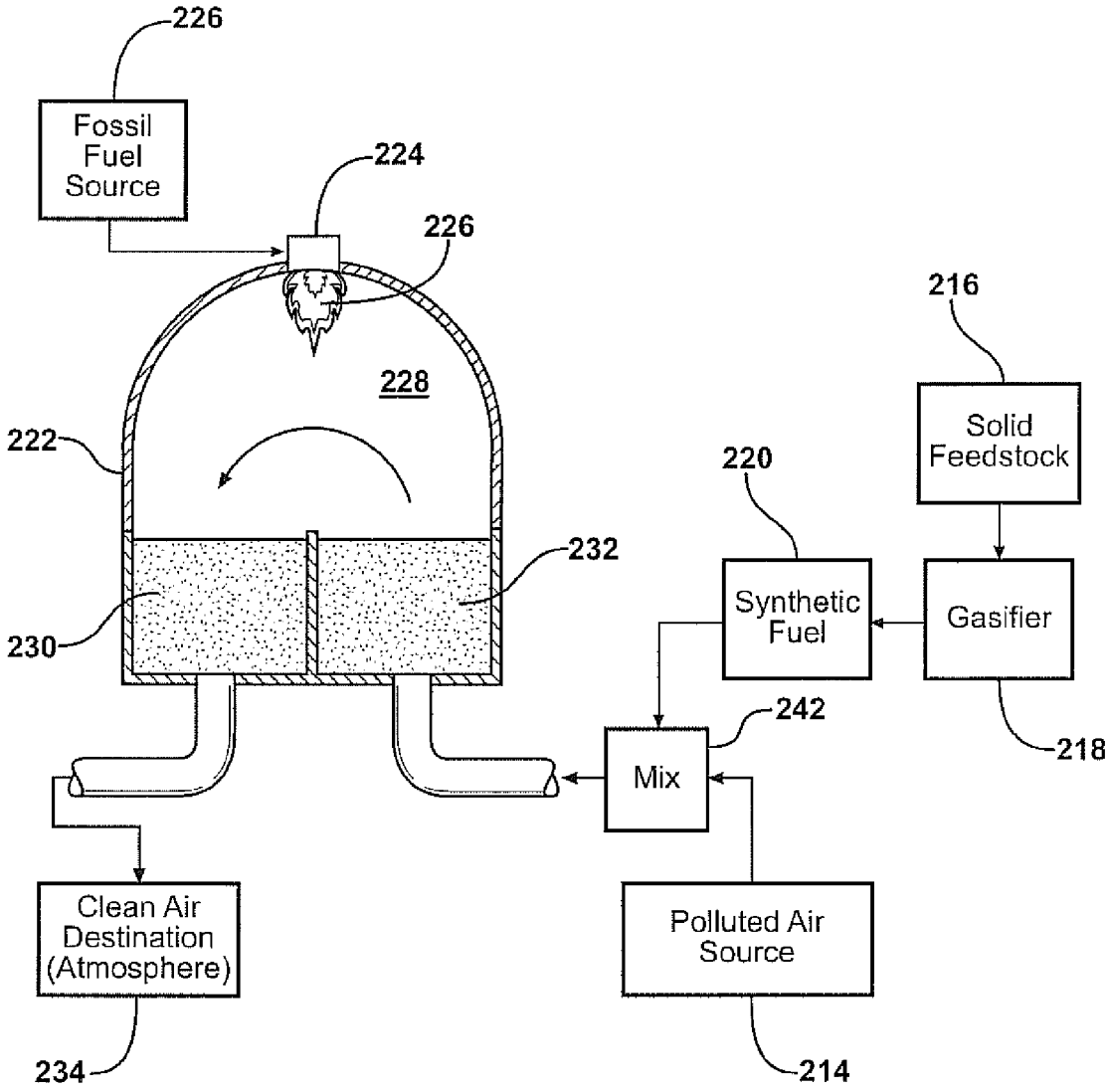
FIG. 3 shows a block diagram of an RTO with a gasifier using a mixer to mix synthetic gas from the gasifier with a polluted air source.

FIG. 3 shows a further alternate embodiment of the RTO at 222 where common elements to FIG. 1 are numbered in the 200 series for simplicity. In this embodiment, the synthetic gas 220 received from the gasifier 218 is delivered to a mixer 242. In some operations, the concentration of pollutants received from the polluted air source 214 is such that heat released by the oxidation reaction is sufficient to sustain the operation of the RTO 222 and the fossil fuel burner 224 can be shut down. This is considered a self-sustaining operation where synthetic gas 220 received from the gasifier 218 is mixed with polluted air from a polluted air source 214 in the mixer 242 at the inlet of the RTO 222. Therefore, the synthetic gas 220, functions as an additional pollutant oxidizing in the RTO and providing heat energy to reduce or fully eliminate the requirement of a burner 224 charged by fossil fuel. Furthermore, operating in this manner reduces significantly the amount of combustion air required by the burner further reducing the potential for carbon dioxide emissions exiting the RTO 222 through the clean air conduit 234.

Figure 4:
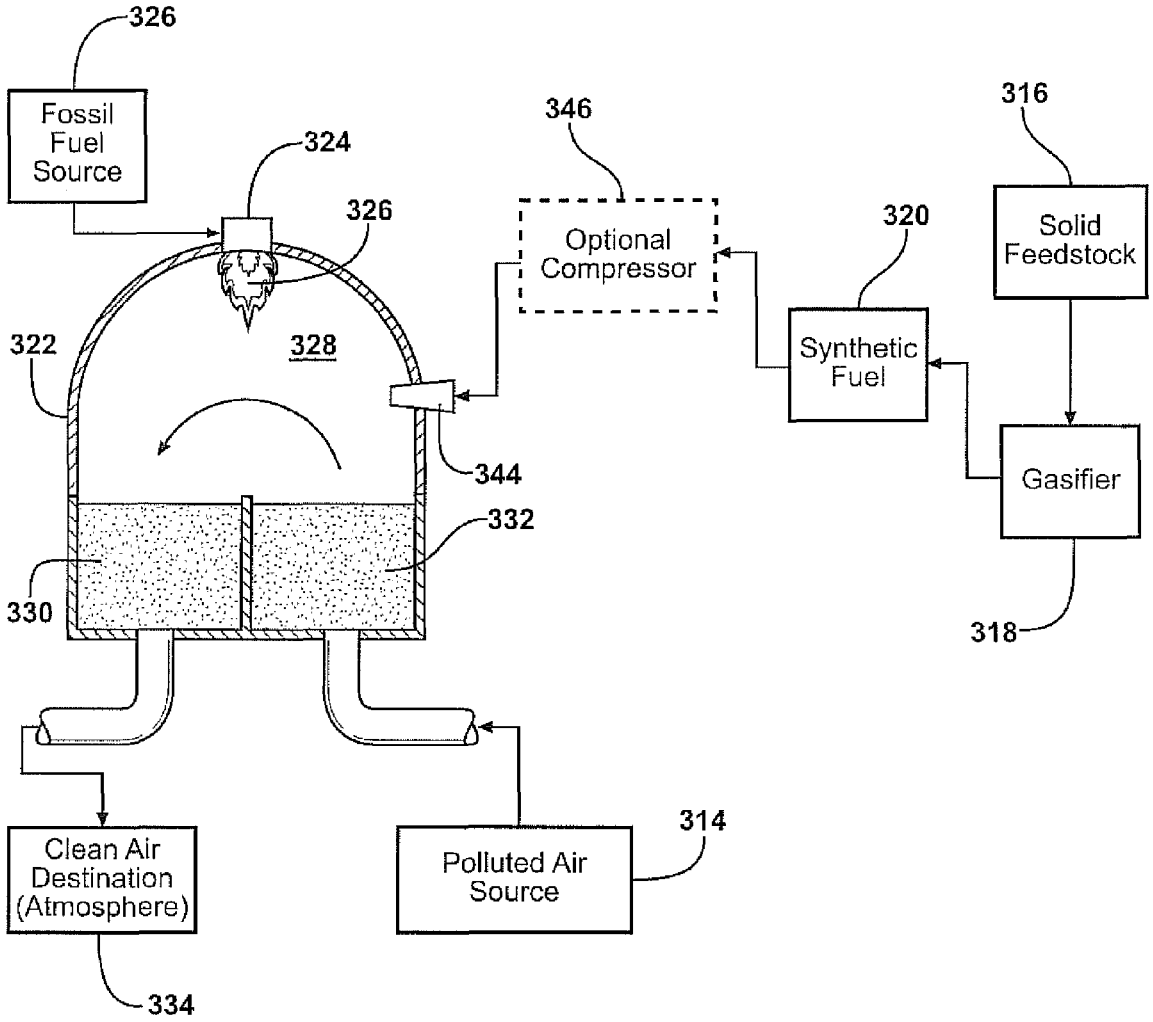
FIG. 4 shows a block diagram of an RTO with a gasifier using an inlet fuel injector.

A still further embodiment of the inventive RTO 322 is shown in FIG. 4 where common elements to FIG. 1 are numbered in the 300 series for simplicity. In this embodiment, synthetic gas is transferred from the gasifier 318 directly into the combustion chamber 328 of the RTO 322. The synthetic gas 320 received from the gasifier 318 will spontaneously oxidize or burn inside the combustion chamber 328 with polluted air received from the polluted air source 314. A conventional fossil fuel burner 324 is used to ignite the combustion chamber 328 and may continue to run during periods when the synthetic gas 320 is being injected into the combustion chamber 328 or when synthetic gas 320 is not available. It is contemplated by the inventors that an injection nozzle 344 is used to optimize the introduction of the synthetic gas 320 into the combustion chamber 328. Additionally, a booster fan or compressor 346 may also be used to increase the pressure of the synthetic gas 320 being sprayed via the nozzle 344 into the combustion chamber 328 to ensure proper mixing with the polluted air. Multiple nozzles 344 may also be used to improve heat distribution of the synthetic gas 320 throughout the combustion chamber 328. If necessary, the nozzle 344 may be cooled with a cooling liquid or gas to prevent the synthetic gas 320 from cracking and forming soot before issuing from the nozzle 344.

Figure 5:
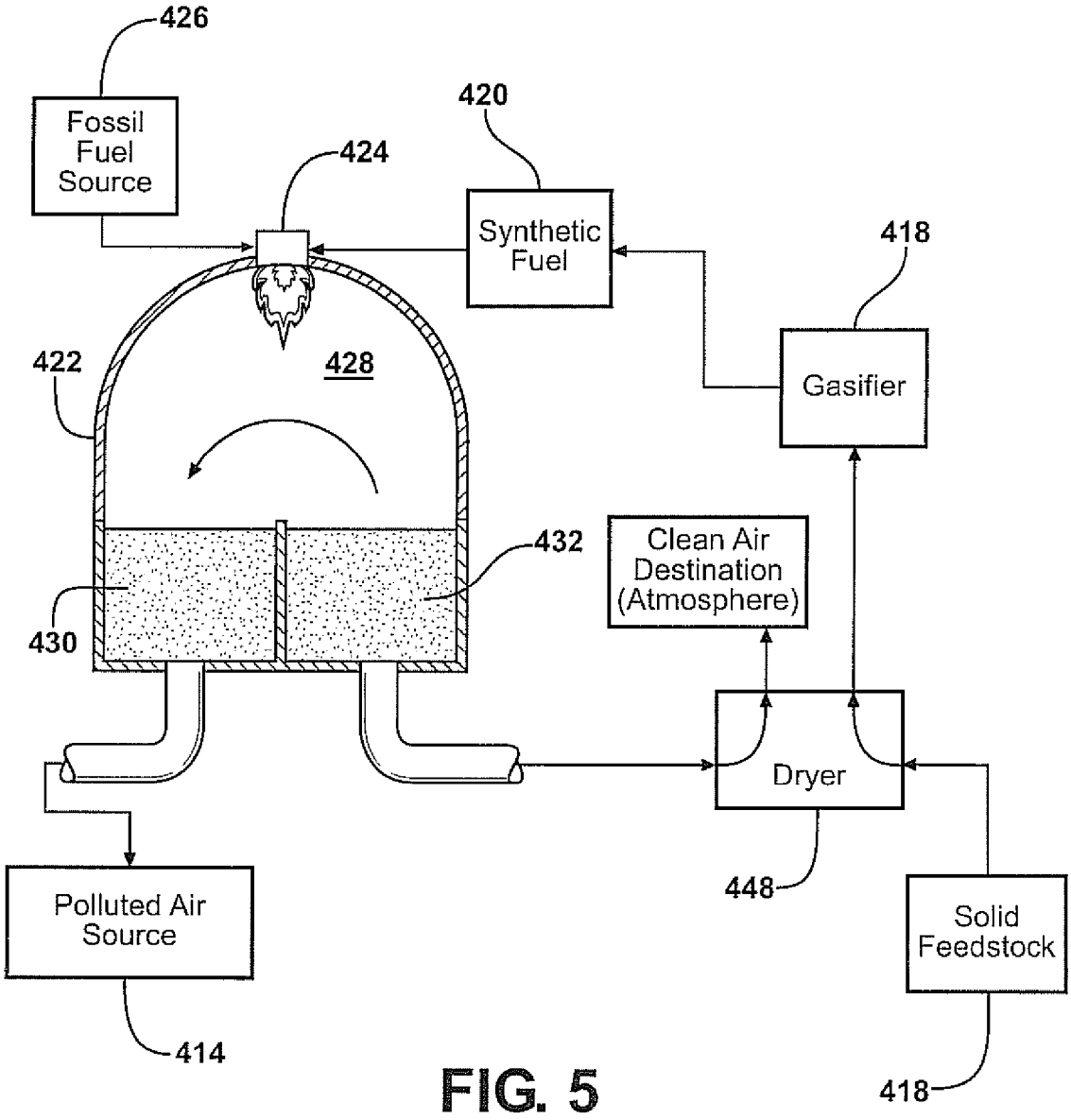
FIG. 5 shows a block diagram of an RTO with a gasifier making use of a dryer to dry the solid waste prior to being received by the gasifier.

A still further embodiment of the RTO 422 is shown in FIG. 5 wherein like elements to those in FIG. 1 are numbered in the 400 series for simplicity. In this embodiment, a dryer 448 is used to dry the solid waste feed product 418 prior to introduction to the gasifier 418. To further reduce costs associated with operating the inventive RTO 430, the clean air vent 434 of the RTO 422 passes through the dryer 448 to dry the solid feed stock 418 making use of the heat resultant from the combustion chamber 428.

Figure 6:
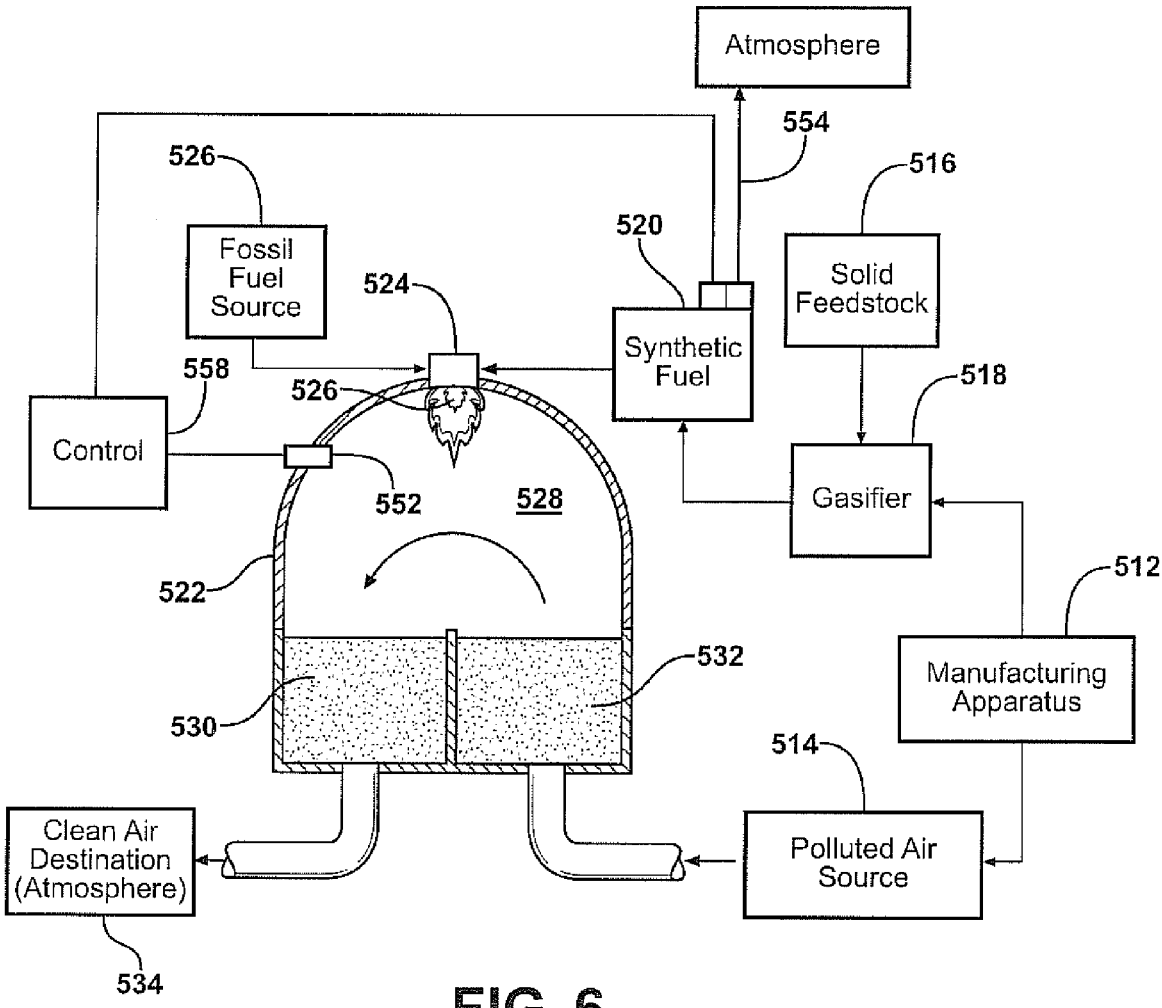
FIG. 6 shows a block diagram of an RTO with a gasifier making use of a sensor and a controller to optimize the process.

Referring to FIG. 6, a still further embodiment of the inventive RTO is shown at 522 wherein like elements to FIG. 1 are numbered in the 500 series for simplicity. In this embodiment, a controller 550 is connected to a thermocouple 552 to control the combustion chamber 528 in a desired temperature range known for efficient operation. The controller 550 receives a temperature measurement from the thermocouple 552 and signals an adjustment to the fuel input from the fossil fuel source 526 and the synthetic gas 520 received from the gasifier 518. A control valve is used to control the inflow of fossil fuel and synthetic gas to the burner 524 in a known manner. Maintaining the temperature in the combustion chamber 528 in a desired range. If the controller 550 determines that too much synthetic gas is being introduced to the burner 524 via the gasifier 518, synthetic gas may be vented through a vent stack 554 for venting excess synthetic gas 520 to atmosphere. The vent stack 554 may include a flare or other ignition device to burn excess fuel prior to being discharged to the atmosphere. Alternatively, the vent stack 554 could deliver excess fuel into a dryer, oven, or other thermal equipment required of the manufacturing apparatus 512. Additional features may be necessary to control the synthetic gas being introduced to the RTO 522 including, filters to remove unwanted particulate matter, cooling apparatus to reduce the temperature of the synthetic gas prior to introduction to the RTO 522, enrichment of the synthetic gas with a fossil fuel to more efficiently burn in the RTO 522, and dilution of the synthetic gas to reduce its heat content for balancing the combustion chamber 528 of the RTO 522.

Preferred embodiments of this invention have been disclosed, however, a worker of ordinary skill in the art would recognize that certain modifications would come within the scope of this invention. The following claims should be studied to determine the true scope and content of this invention. It should also be understood that the scope of the invention includes braking down carbon dioxide vented from the thermal oxidizer 22 into elemental forms of carbon and oxygen that are exhausted to the atmosphere. Known chemical and thermal methods of establishing carbon and oxygen are contemplated by the inventors as set forth above.

What is claimed is:

1. A method of reducing waste resulting from operating a manufacturing apparatus, comprising the steps of:

operating a manufacturing apparatus thereby producing aerosol waste product and solid waste product;

directing the aerosol waste product to a thermal oxidizer so as to reduce the aerosol waste product to carbon dioxide by introducing to said thermal oxidizer fossil fuel at a first energy rate;

directing the solid waste product to a gasifier so as to convert the solid waste product to synthetic gas at a second energy rate having a lower BTU level than said fossil fuel; and routing the synthetic gas produced by said gasifier into said thermal oxidizer and balancing the flow rate of the synthetic gas with the flow of the fossil fuel so as to reduce the flow rate of the fossil fuel and reduce the carbon dioxide vented from the thermal oxidizer resultant from the fossil fuel.

2. The method set forth in claim 1, further including the step of reducing carbon dioxide vented from the thermal oxidizer to elemental components of carbon and oxygen.

3. The method set forth in claim 1, wherein said step of balancing the flow rate of the synthetic gas with the flow of fossil fuel is further defined by stopping the flow of fossil fuel when enough synthetic gas is available to operate the thermal oxidizer.

4. The method set forth in claim 1, wherein said step of routing the synthetic gas produced by said gasifier into said thermal oxidizer is further defined by pressurizing the synthetic gas for improved distribution throughout the thermal oxidizer.

5. The method set forth in claim 1, wherein said step of routing the synthetic gas produced by said gasifier into said thermal oxidizer is further defined by routing the synthetic gas into a burner used to heat the thermal oxidizer.

6. The method set forth in claim 1, wherein said step of routing the synthetic gas produced by said gasifier into said thermal oxidizer is further defined by routing the synthetic gas into a combustion chamber of the thermal oxidizer.

7. The method set forth in claim 1, wherein said step of routing the synthetic gas produced by said gasifier into said thermal oxidizer is further defined by mixing the synthetic gas with a polluted air stream being delivered to the thermal oxidizer.

* * * * *